US012404081B2

(12) United States Patent
Ballou

(10) Patent No.: US 12,404,081 B2
(45) Date of Patent: Sep. 2, 2025

(54) BEVERAGE CONTAINER AND CARABINER ASSEMBLY

(71) Applicant: Nuataaq Holdings, LLC, Croton on Hudson, NY (US)

(72) Inventor: Daniel Ballou, Long Beach, CA (US)

(73) Assignee: NUATAAQ HOLDINGS, LLC, Croton on Hudson, NY (US)

( * ) Notice: Subject to any disclaimer, the term of this patent is extended or adjusted under 35 U.S.C. 154(b) by 96 days.

(21) Appl. No.: 18/303,906

(22) Filed: Apr. 20, 2023

(65) Prior Publication Data

US 2024/0351757 A1 Oct. 24, 2024

(51) Int. Cl.

| | |
|---|---|
| ***B65D 51/24*** | (2006.01) |
| ***A45F 3/18*** | (2006.01) |
| ***A45F 5/00*** | (2006.01) |
| ***B65D 23/10*** | (2006.01) |
| ***B65D 43/02*** | (2006.01) |
| ***B65D 53/02*** | (2006.01) |

(52) U.S. Cl.

CPC ..... *B65D 51/242* (2013.01); *A45F 3/18* (2013.01); *A45F 5/00* (2013.01); *B65D 23/102* (2013.01); *B65D 43/0229* (2013.01); *B65D 53/02* (2013.01)

(58) Field of Classification Search

CPC ..... B65D 51/242; B65D 23/102; B65D 43/0229; A45F 3/18

USPC ..... 220/212, 212.5, 810, 737, 710.5

See application file for complete search history.

(56) References Cited

U.S. PATENT DOCUMENTS

| | | | | | |
|---|---|---|---|---|---|
| 3,394,830 | A * | 7/1968 | Schiavo | B65D 50/068 | 215/220 |
| 4,804,101 | A * | 2/1989 | Heath | A24F 23/00 | 312/73 |
| 4,896,782 | A * | 1/1990 | Hawkins | B65D 51/18 | 215/276 |
| 5,078,291 | A * | 1/1992 | Gilmour | B65D 45/24 | 215/396 |
| 5,158,194 | A * | 10/1992 | Sirgo | B65D 50/041 | 215/217 |
| 5,664,712 | A * | 9/1997 | Smrt | A45F 5/02 | 224/904 |

(Continued)

FOREIGN PATENT DOCUMENTS

| | | |
|---|---|---|
| CN | 105923252 | 9/2016 |
| EP | 3784578 | 10/2019 |

(Continued)

*Primary Examiner* — Anthony D Stashick
*Assistant Examiner* — Prince Pal
(74) *Attorney, Agent, or Firm* — Simpson & Simpson, PLLC

(57) ABSTRACT

A beverage container and carabiner assembly including a container having a distal end and a proximal end, the container having a cavity therein, the container having a threaded mouth at the proximal end, the mouth in communication with the cavity, a threaded cap having a distal end and a proximal end, the cap having a through-bore therein proximate the proximal end, the cap operatively arranged to threadably and removably engage the threaded mouth of the container, and a carabiner, the carabiner having a proximal section, a distal section, and a clip, the distal section of the carabiner arranged within the through-bore of the cap.

9 Claims, 9 Drawing Sheets

(56) References Cited

U.S. PATENT DOCUMENTS

D559,694 S 1/2008 Le Bras-Brown et al.
D568,740 S 5/2008 Williams
D602,247 S * 10/2009 Oas ..... D3/208
D623,067 S 9/2010 Lovelace, Jr. et al.
D632,182 S 2/2011 Russell et al.
D635,461 S 4/2011 Inoi
D646,980 S 10/2011 Inoi
8,136,693 B2 * 3/2012 Thatcher ..... B65D 47/243 220/717
8,215,511 B1 * 7/2012 Lin ..... B65D 51/242 215/396
8,297,462 B1 * 10/2012 Joyce ..... F16B 45/026 215/396
D671,007 S 11/2012 Lovelace, Jr. et al.
8,376,162 B2 * 2/2013 Yang ..... B65D 47/249 220/717
8,408,414 B2 * 4/2013 Roth ..... B65D 45/025 220/814
D701,123 S 3/2014 Lo et al.
8,777,039 B2 7/2014 Roth et al.
D742,230 S * 11/2015 Charles ..... D9/449
D748,486 S 2/2016 Clarke
D749,954 S 2/2016 Darr
D756,233 S 5/2016 Romero
D759,494 S 6/2016 Hanan et al.
9,387,976 B2 * 7/2016 Geis ..... B65D 83/384
D803,061 S 11/2017 Darr
9,944,438 B2 4/2018 Roth et al.
D842,104 S 3/2019 Ke
D844,435 S * 4/2019 Deylamian ..... D9/503
10,251,468 B1 4/2019 Moore et al.
10,292,480 B2 * 5/2019 Facer ..... A45F 5/02
D891,089 S * 7/2020 He ..... D3/207
D897,781 S * 10/2020 Hirsch ..... D7/511
D910,450 S 2/2021 Bhat et al.
D915,216 S 4/2021 Miller
D917,294 S 4/2021 Alima et al.
D932,905 S 10/2021 Klok et al.
11,254,476 B1 * 2/2022 Weng ..... B65D 43/0235
11,370,595 B2 * 6/2022 Rojas ..... A47G 19/2266
D958,661 S 7/2022 Safiullah
D959,273 S 8/2022 Joshi et al.
11,707,122 B2 * 7/2023 Lockwood ..... A45C 13/02 206/6.1
D1,020,247 S * 4/2024 Zhang ..... D3/208
D1,048,814 S * 10/2024 Deylamian ..... D9/503
2003/0111496 A1 * 6/2003 Abbott ..... A45F 5/02 224/269
2004/0250386 A1 12/2004 Goldberg
2005/0211661 A1 * 9/2005 Galownia ..... B65D 23/102 215/382
2006/0208515 A1 * 9/2006 Murphy ..... B65D 33/02 294/137
2008/0078787 A1 * 4/2008 Yelland ..... B65D 51/242 224/148.1
2010/0224631 A1 * 9/2010 Roth ..... B65D 45/025 220/288
2010/0282703 A1 * 11/2010 Yang ..... B65D 47/249 215/228
2011/0198361 A1 * 8/2011 Chen ..... A47G 19/2266 220/709
2011/0220674 A1 * 9/2011 Honeyghan ..... A47G 19/22 220/849
2011/0297678 A1 * 12/2011 Lane ..... B65D 47/088 220/212
2012/0012478 A1 * 1/2012 Berman ..... A45C 13/008 206/223
2012/0292790 A1 11/2012 Tatera
2013/0062348 A1 3/2013 Thatcher
2013/0153453 A1 * 6/2013 Simpson ..... B65D 85/00 206/389
2015/0265083 A1 * 9/2015 Myers ..... B65D 25/54 220/737
2015/0307237 A1 * 10/2015 Kinsman ..... B65D 47/42 401/134
2015/0351568 A1 12/2015 Blain et al.
2015/0360927 A1 * 12/2015 Sweeney ..... G01B 21/22 222/41
2016/0130036 A1 * 5/2016 Coyle ..... F24D 3/1008 220/475
2017/0188731 A1 * 7/2017 Schuller ..... A47G 23/16
2017/0224076 A1 * 8/2017 Lockwood ..... A45C 11/16
2017/0238744 A1 * 8/2017 Sweeney ..... G01F 13/006
2017/0258188 A1 * 9/2017 Luo ..... A45C 13/008
2018/0162582 A1 * 6/2018 Deylamian ..... B65D 1/06
2019/0075973 A1 * 3/2019 Charleson ..... A47J 43/27
2019/0152655 A1 * 5/2019 Lake ..... B65D 51/242
2020/0140135 A1 * 5/2020 Deylamian ..... B65D 51/242
2020/0148430 A1 * 5/2020 Cornelius ..... B65D 47/088
2020/0166073 A1 * 5/2020 Medina Luna ..... B67B 7/16
2020/0332485 A1 * 10/2020 Garland ..... A45F 5/02
2020/0407112 A1 * 12/2020 Miksovsky ..... B65D 51/242
2021/0147127 A1 * 5/2021 Kitto ..... B65D 47/065
2021/0284376 A1 9/2021 Hossain
2021/0284427 A1 * 9/2021 Rojas ..... B65D 43/0231
2022/0250782 A1 * 8/2022 Deylamian ..... B65D 41/04
2022/0265978 A1 * 8/2022 Bobosikova ..... A61M 35/003
2022/0274765 A1 * 9/2022 Kirstein ..... A45D 40/00
2022/0349439 A1 * 11/2022 Cowell ..... F16B 45/024
2022/0378180 A1 12/2022 Perrault
2023/0249876 A1 * 8/2023 Nadershahi ..... F41B 15/02 215/397
2023/0271756 A1 * 8/2023 Goodall ..... B65D 41/465 215/255
2023/0322478 A1 * 10/2023 Terrell ..... B65F 1/062 220/495.07
2024/0239572 A1 * 7/2024 Enghard ..... B65D 51/242
2024/0351757 A1 * 10/2024 Ballou ..... A45F 5/1583

FOREIGN PATENT DOCUMENTS

KR 10-0973095 7/2010
KR 10-2011-0119213 11/2011
KR 10-2012-0137999 12/2012
KR 2016-0001286 4/2016
WO 2016/163924 10/2016

* cited by examiner

BEVERAGE CONTAINER AND CARABINER ASSEMBLY

FIELD

The present invention relates to a beverage container having a carrying system removably secured in a cap of the container. More specifically, the invention relates to a carrying system which includes a carabiner secured within a cap of a water bottle.

BACKGROUND

Reusable water bottles have become mainstream in recent years, primarily as an effort to reduce waste. Various name-brand companies have developed reusable water bottles with a plurality of features, such as, insulated walls to keep contents hot or cold and varieties of cap arrangements providing different drinking experiences.

An issue with some water bottles relates to a means for carrying them. Due to their various sizes and shapes, carrying mechanisms have been developed in various configurations. One of these mechanisms is a cap having an integrated handle, typically constructed of the same material and extending therefrom.

However, these handle solutions are arranged such that a closed loop is formed by the integrated handle, thereby requiring the use of another device to connect the handle to a desirable object, such as a backpack, travel bag, luggage, etc.

In many arrangements, carabiner clips are used as a connecting element between the integrated handle and the object. Although this solution temporarily cures the above-mentioned problem, it also introduces an additional component to the water bottle that can be removed and lost.

An example of the aforementioned combination is disclosed in U.S. Published Patent Application No. 2021/0147127. The '127 application discloses a fluid container having a lid that is arranged to accept a carabiner therein. The bottle generally includes a vessel, or container having a lid and a magnet thereon. The container includes threads arranged within an inner surface of a mouth of the container that are arranged to removably secure the lid, by way of threads, to the container. The lid further includes a carabiner support with a substantially annular-ring shaped configuration extending from an upper surface thereon, whereas the carabiner support is arranged to accept a carabiner therein. The carabiner can still be removed from the carabiner support.

Therefore, it is desirable to create a handle that is more integrally arranged with the cap, i.e., no additional extending components, nor a carabiner that can be removed. U.S. Published Patent Application No. 2019/0152655 discloses a container and a cap having a handle integrated into the cap. The cap is disclosed to have a base with a wall arranged to have threading thereon. The base further includes oppositely disposed apertures. The base extends from a terminal end portion. The handle includes a sleeve with oppositely arranged end portions, whereas the end portions are arranged to be seated within apertures, allowing the handle to be rotatably connected to the base of the cap. The configuration does provide a handle but does not utilize a carabiner and is configured as a closed loop.

Thus, there is a long felt need for a beverage container (e.g., a water bottle) having a cap, where the cap includes an integrated handle, where the handle takes the form of a carabiner and is integrated in a manner where the carabiner cannot be removed from the cap.

There is also a long felt need for a carabiner and cap combination for a water bottle where the carabiner is integrated therein in such a way that no additional components extend from the cap.

SUMMARY

According to aspects illustrated herein, the present invention generally comprises a beverage container and carabiner assembly including a container having a distal end and a proximal end, the container having a cavity therein, the container having a threaded mouth at the proximal end, the mouth in communication with the cavity, a threaded cap having a distal end and a proximal end, the cap having a through-bore therein proximate the proximal end, the cap operatively arranged to threadably and removably engage the threaded mouth of the container, and a carabiner, the carabiner having a proximal section, a distal section, and a clip, the distal section of the carabiner arranged within the through-bore of the cap.

The present invention may also generally comprise a carabiner cap combination, the carabiner cap combination having a cap having a first end and a second end, a protrusion extending from the first end, the protrusion having threads arranged on an outer surface, a through-bore disposed therein and proximate the proximal end, and a carabiner, the carabiner having a proximal section, a distal section, and a clip, the distal section of the carabiner arranged within the through-bore of the cap, wherein the carabiner may rotate within the through-bore.

In some embodiments, the present invention may comprise a carabiner cap combination including a cap having a proximal end and a distal end, a protrusion extending from the distal end, the protrusion having threads arranged on an outer surface, a through-bore disposed within the cap, and a carabiner, the carabiner having a proximal section, a distal section, and a clip, the distal section of the carabiner arranged for rotation within the through-bore of the cap.

In other embodiments, the present invention may include a beverage container and carabiner assembly having a container having a cavity, the container having a threaded mouth in communication with the cavity, a threaded cap having a through-bore therein, the cap operatively arranged to threadably engage the threaded mouth of the container, and a carabiner, a part of which is fixedly secured within the through-bore of the cap.

In some arrangements, the carabiner of the aforementioned present invention could comprise a frame, the frame having a nose arranged at a first end and a pivot end arranged at a second end, the frame having a spine arranged substantially between the nose and the pivot end, the frame including an arched portion arranged proximate the nose, the frame also including a longitudinal portion proximate the pivot end, and a gate pivotably secured to the pivot end and arranged to engage the nose, wherein the gate and the spine are spaced part at a first length, wherein the arched portion and the longitudinal portion are spaced apart at a second length, whereas the first length is greater than the second length.

These and other objects, features, and advantages of the present invention will become readily apparent upon a review of the following detailed description of the invention, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

Figure 1:
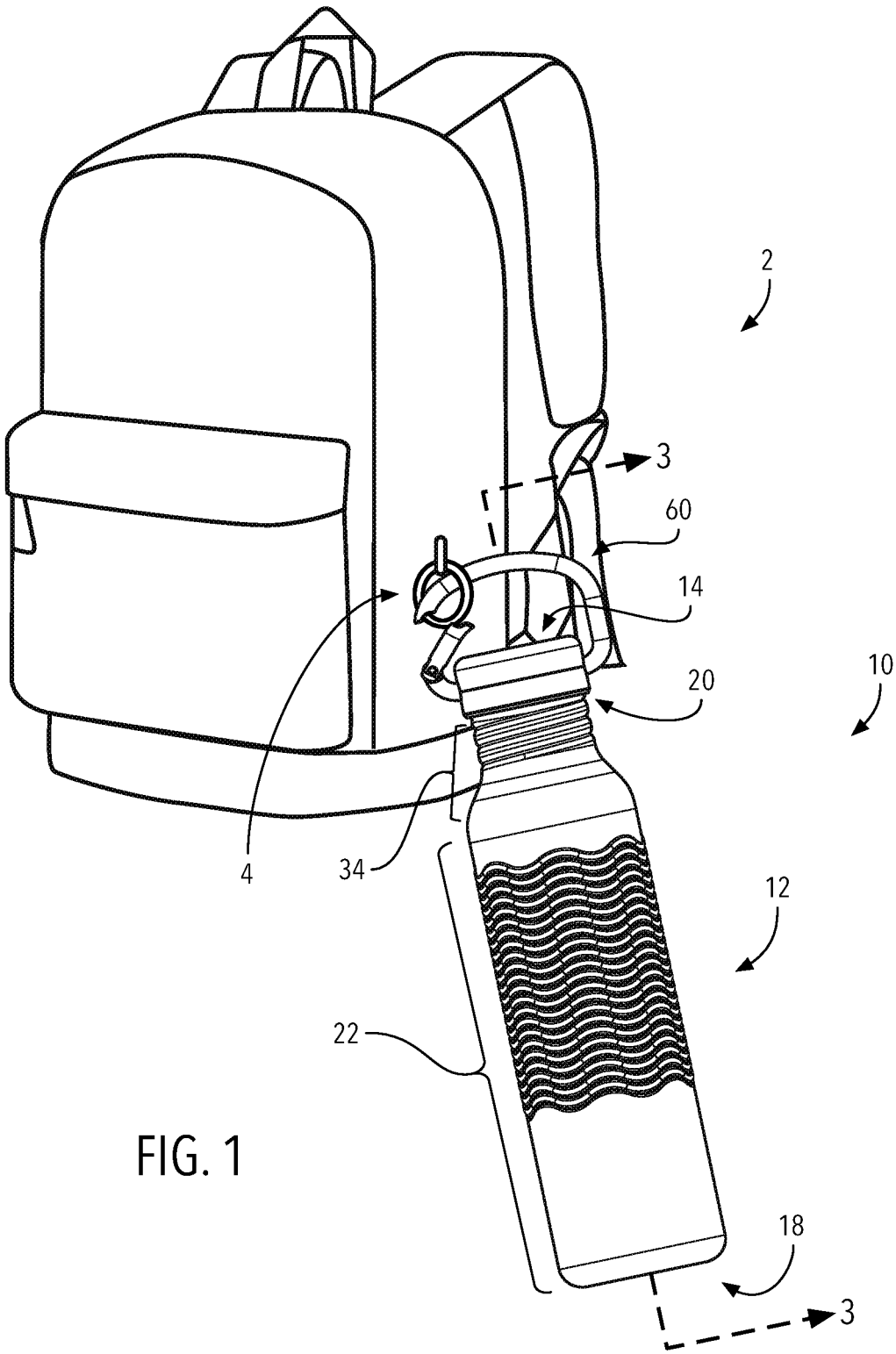
FIG. 1 is a perspective view of the present invention in use.

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

It should be understood that use of "or" in the present application is with respect to a "non-exclusive" arrangement, unless stated otherwise. For example, when saying that "item x is A or B," it is understood that this can mean one of the following: (1) item x is only one or the other of A and B; (2) item x is both A and B. Alternately stated, the word "or" is not used to define an "exclusive or" arrangement. For example, an "exclusive or" arrangement for the statement "item x is A or B" would require that x can be only one of A and B. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Moreover, as used herein, the phrases "comprises at least one of" and "comprising at least one of" in combination with a system or element is intended to mean that the system or element includes one or more of the elements listed after the phrase. For example, a device comprising at least one of: a first element; a second element; and, a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element. A similar interpretation is intended when the phrase "used in at least one of:" or "at least one of" is used herein.

Figure 2:
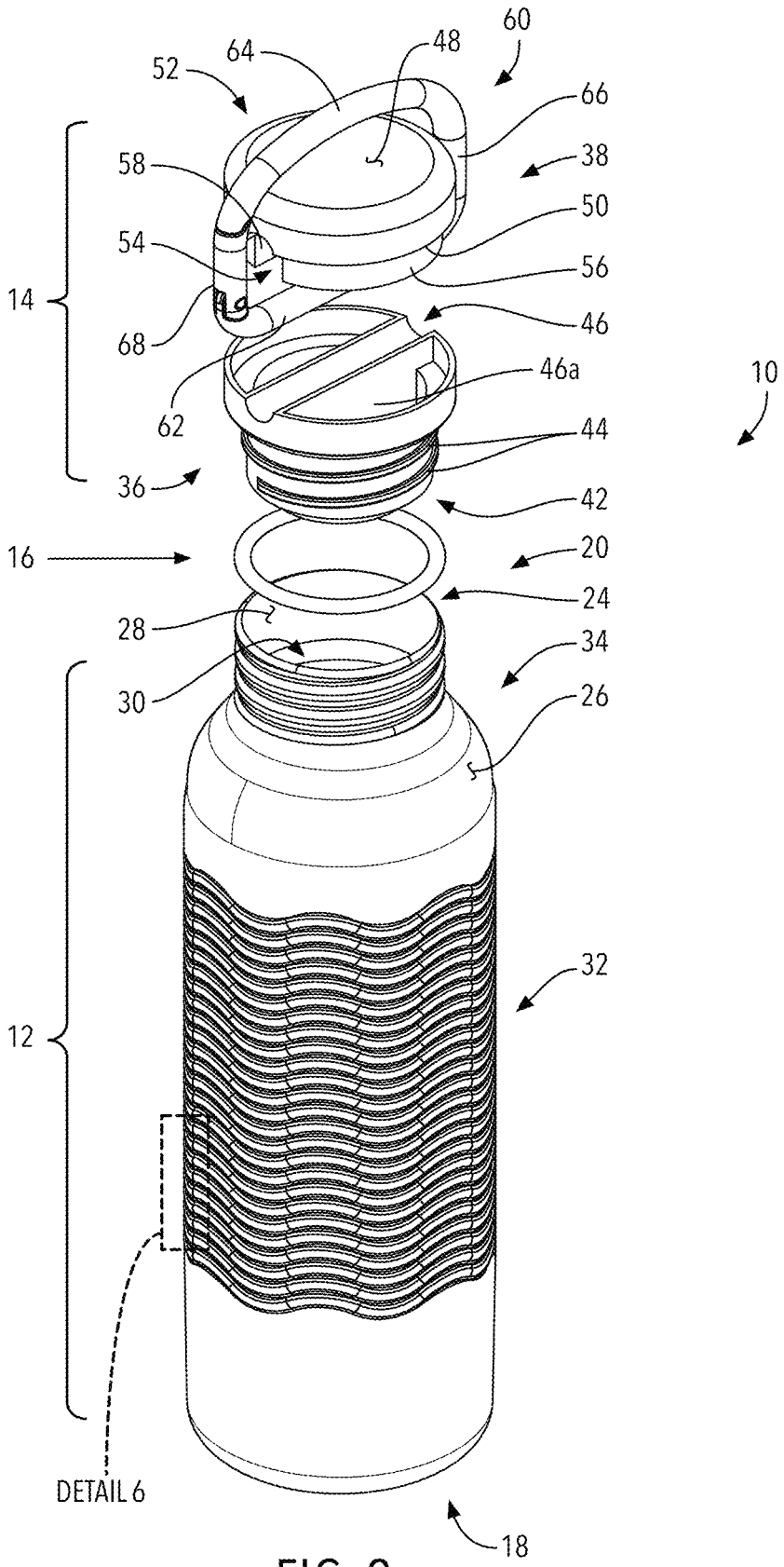
FIG. 2 is an exploded view of the present invention shown in FIG. 1.
Figure 3:
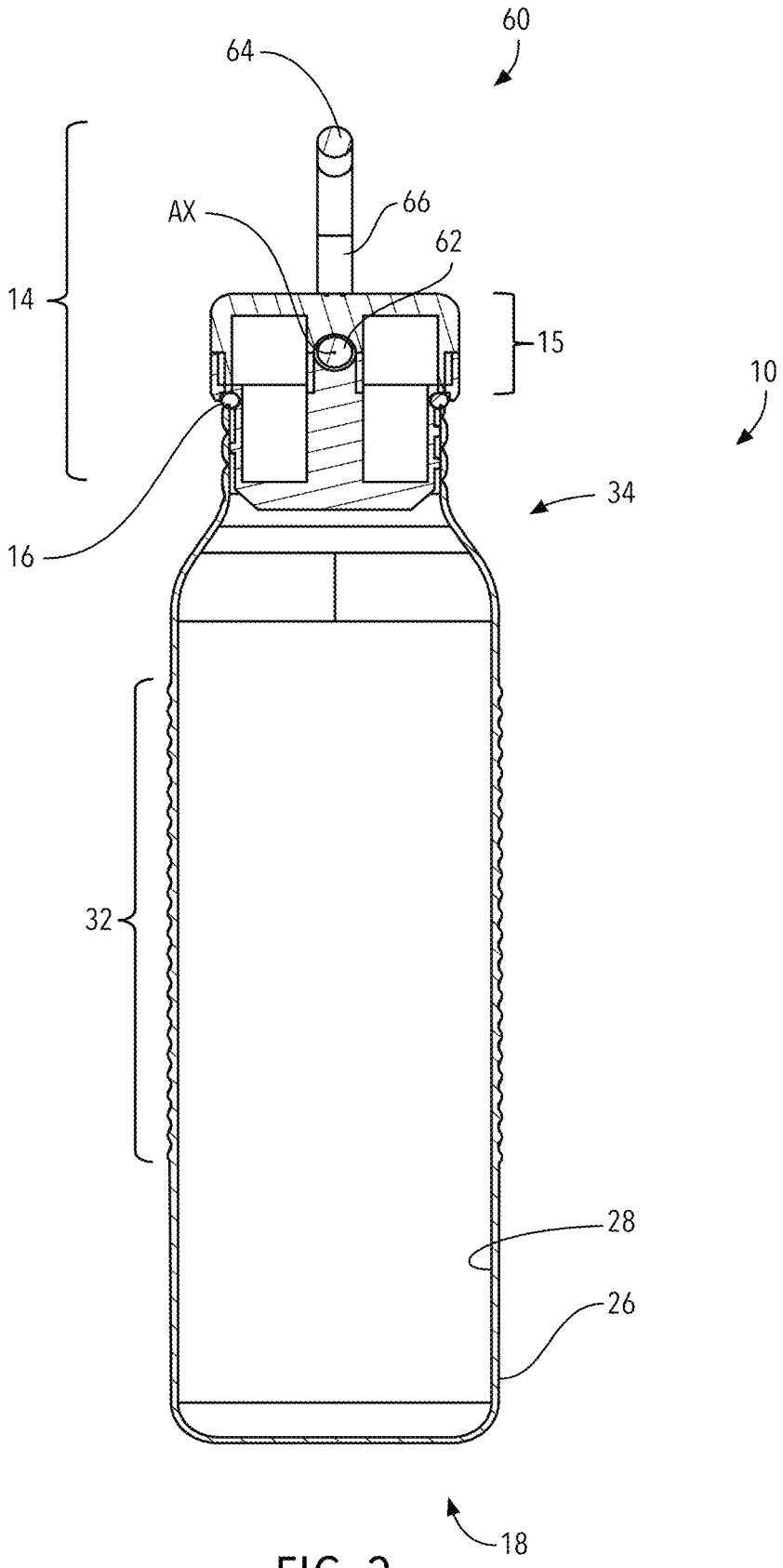
FIG. 3 is a cross-sectional taken generally along line 3-3 in FIG. 1.

Adverting now to the drawings. The following description should be taken in view of FIGS. 1 through 3. FIG. 1 illustrates the present invention, carabiner bottle 10 attached to article 2, specifically ring 4 of article 2. Carabiner bottle 10 includes carabiner 60 which allows bottle 10 to be removably secured to an object. FIGS. 2 and 3 generally illustrate an exploded view of carabiner bottle 10 and a cross-sectional view taken generally along line 3-3 in FIG. 1. Carabiner bottle 10 generally comprises container 12, carabiner cap combination 14, and O-ring 16.

In some arrangements, container 12 includes distal end 18, proximal end 20, body 22, mouth 24, and neck 34. Body 22 has outer surface 26 and inner surface 28. Body 22 extends from distal end 18 proximate proximal end 20, thereby transitioning to neck 34. Neck 34 extends to proximal end 20 and is terminated by mouth 24. Mouth 24 is an aperture within neck 34. Threading 30 is arranged on inner surface 28 within mouth 24 and/or neck 34.

Container 12 includes plurality of gripping members 32 arranged on body 22. There could also be a plurality of gripping members arranged on neck 34. Specifically, plurality of gripping members 32 extend from, or are within, or a combination thereof, outer surface 26 of container 12, arranged in either, or both, of body 22 and neck 34, preferably disposed between distal end 18 and proximal end 20. In a preferred embodiment, plurality of gripping members 32 are arranged on body 22 and disposed between distal end 18 and neck 34. Plurality of gripping members 32 is shown and discussed further in view of FIGS. 6A through 6F, infra.

In some embodiments, container 12 is configured as a double wall insulated stainless steel container. In one embodiment, container 12 is configured as a single wall stainless steel container. It should be appreciated however, that alternative materials may be used in the construction of container 12, such as metal and plastic combinations, plastics, polymers, various different types of metals, etc. As such, those in the art will understand that any suitable material, now known or hereafter developed, may be used in forming container 10 described herein and supra.

Carabiner bottle 10 also includes O-ring 16, which is arranged to be sandwiched between mouth 24 and/or proximal end 20 when carabiner cap combination 14 is engaged to container 12—thereby providing a water-tight seal between container 12 and carabiner cap combination 14.

Figure 4B:
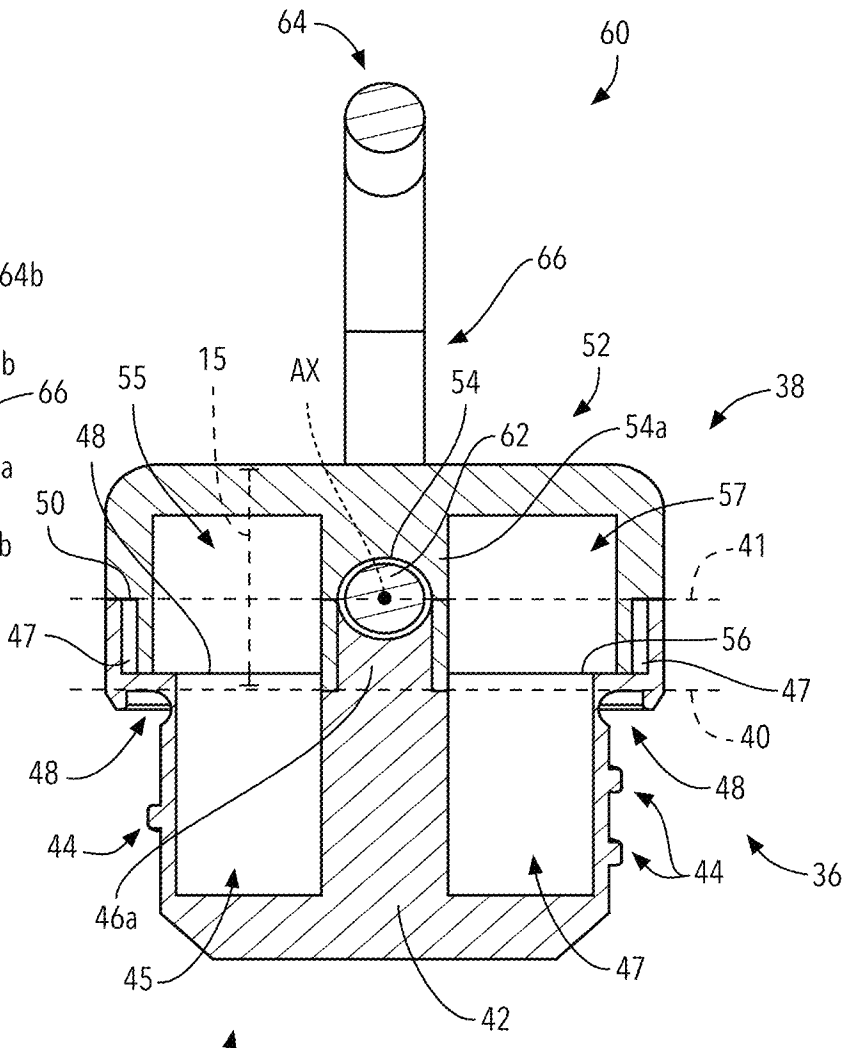
FIG. 4B is a cross-sectional view taken generally along line 4B-4B in FIG. 4A.
Figure 4A:
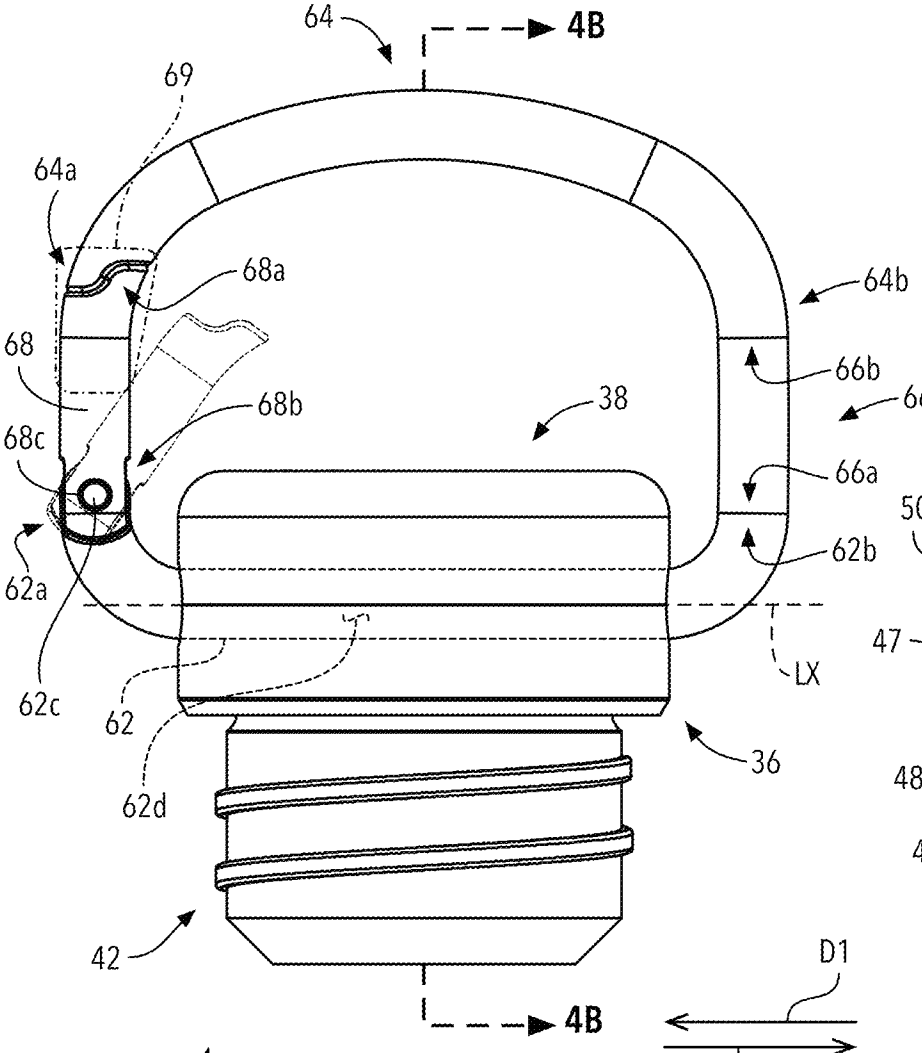
FIG. 4A is a front view of the cap of the present invention shown in FIG. 1.

The following description should be taken in view of the aforementioned figures and FIGS. 4A and 4B. FIG. 4A generally illustrates a front view of carabiner cap combination 14 and FIG. 4B illustrates a cross-sectional view of same taken generally along line 4B-4B in FIG. 4A. Carabiner cap combination 14 is preferably a singular component having carabiner 60 fixedly secured within a through-bore disposed within body 15 of carabiner cap combination. In some embodiments, carabiner cap combination 14 comprises distal portion 36 and proximal portion 38, whereas distal portion 36 and proximal portion 38 are arranged to be fixedly secured, having carabiner 60 therein, forming cap 14.

Distal portion 36 of cap 14 generally includes distal surface 40, proximal surface 41, outer surface 43, protrusion 42, and groove 46. Protrusion 42 is arranged to extend from distal surface 40. In a preferred embodiment, protrusion 42 takes a substantially cylindrical configuration that may also have a frustoconical portion arranged at an end of protrusion 42 arranged away from distal surface 40. Threading 44 is arranged on an outside surface of protrusion 42, whereas threading 44 is arranged to threadedly engage threading 30 of container 12. Channel 48 is substantially arranged at least partially within distal surface 40 and preferably takes a circular configuration. Channel 48 is arranged to accept O-ring 16 therein, whereas O-ring 16 is substantially sandwiched within channel 48 when cap 14 is engaged to container 12. O-ring 16 primarily increases the water-tight seal formed by threading 44 and threading 30.

In some embodiments, first cavity 45 and second cavity 47 are formed at least between proximal surface 41 and distal surface 40, arranged between outer surface 43 and groove 46 (whereas groove 46 is positioned within groove body 46*a*). In other arrangements, first cavity 45 and second cavity 47 may extend past distal surface 40 and into protrusion 42.

In some configurations, proximal portion 38 of cap 14 generally includes distal surface 50, proximal surface 52, groove 54, first protruding section 56, and second protruding section 58. First protruding section 56 and second protruding section 58 are arranged to extend from distal surface 50. In some embodiments, first protruding section 56 and second protruding section 58 may also include first cavity 55 and second cavity 57, respectively. Groove 54 is arranged within groove body 54*a*.

Carabiner 60 generally includes distal section 62, proximal section 64, connection section 66, and clip 68. Distal section 62 at least includes a straight portion, i.e., a non-bent portion, that at least has a length which is the same as a length of both grooves 46 and 54. In a preferred embodiment, distal section 62 has a length which is greater than a length of both grooves 46 and 54. Distal section 62 extends from opposing ends into clip 68 and connection section 66, whereas clip 68 and connection section 66 extend in a direction away from distal section. Proximal section 64 is joined to the respective ends of clip 68 and connection section 66 that extend away from distal section 62. Carabiner 60 is generally configured to have a substantially circular cross-section.

In some embodiments, carabiner 60 may include distal section 62, proximal section 64, connection section 66, and clip 68. Distal section 60 may include first end 62*a*, second end 62*b*, and pin 62*c* disposed within an aperture arranged proximate first end 62*a*. Distal section 62 may also include longitudinal portion 62*d*, substantially disposed between first end 62*a* and second end 62*b*, whereas longitudinal portion 62*d* includes longitudinal axis LX. Proximal section 64 may include first end 64*a* and second end 64*b*. Connecting section 66 may include first end 66*a* and second end 66*b*. Clip 68 may include first end 66*a*, second end 66*b*, and aperture 68*c*. In some embodiments, clip 68 may also include locking sleeve 69, which may be threadedly engaged to clip 68 such that rotation there moves locking sleeve in either a direction towards and past first end 66*a* (i.e., a locked position) or a direction towards second end 66*b* (i.e., an unlocked position). Second end 62*b* of distal section 62 is connected to first end 66*a* of connecting section 66. Second end 66*b* of connecting section 66 is connected to second end 64*b* of proximal section 64. First end 64*a* of proximal section 64 and first end 68*a* of clip 68 are arranged to have complimentary arrangements, such that first end 68*a* of clip 68 abuts first end 64*a* of proximal section, thereby restricting first end 68*a* from moving in direction D1, i.e., past first end 64*a* (but can move in direction D2). Clip 68 is rotatably secured to distal section 62 via pin 62*c* within an aperture of first end 62*a* of distal section 62 and within aperture 68*c* of clip 68. In a preferred embodiment, and well known within the art, clip 68 includes a spring mechanism such that first end 68*a* of clip 68 maintains contact with first end 64*a* of proximal section 64 until force, generally in direction D2, is imparted on clip 68.

When cap 14 is assembled, body 15 of cap 14 is formed by proximal portion 38 (bounded by distal surface 50 and proximal surface 52) and a portion of distal portion 36 (the portion bounded by proximal surface 41 and distal surface 40), thus, it can be said that body 15 of cap 14 is the portion of cap 14 substantially arranged between proximal surface 52 and distal surface 40, best shown in FIG. 4B. When cap 14 is assembled, first protruding section 56 and second protruding section 58 of proximal portion 38 are arranged to be at least partially seated within cavities 45 and 47 of distal portion 36, whereas groove 54 and groove 46 thereby form the through-bore of cap 14 which secured holds carabiner 60 therein. In a preferred embodiment, the through-bore (comprised of groove 54 and groove 46) has an internal circumference that is less than an outer circumference of distal portion 62 of carabiner 60—allowing carabiner 60 to rotate within, shown in FIGS. 5A through 5C.

Figures 5A, 5B, 5C:
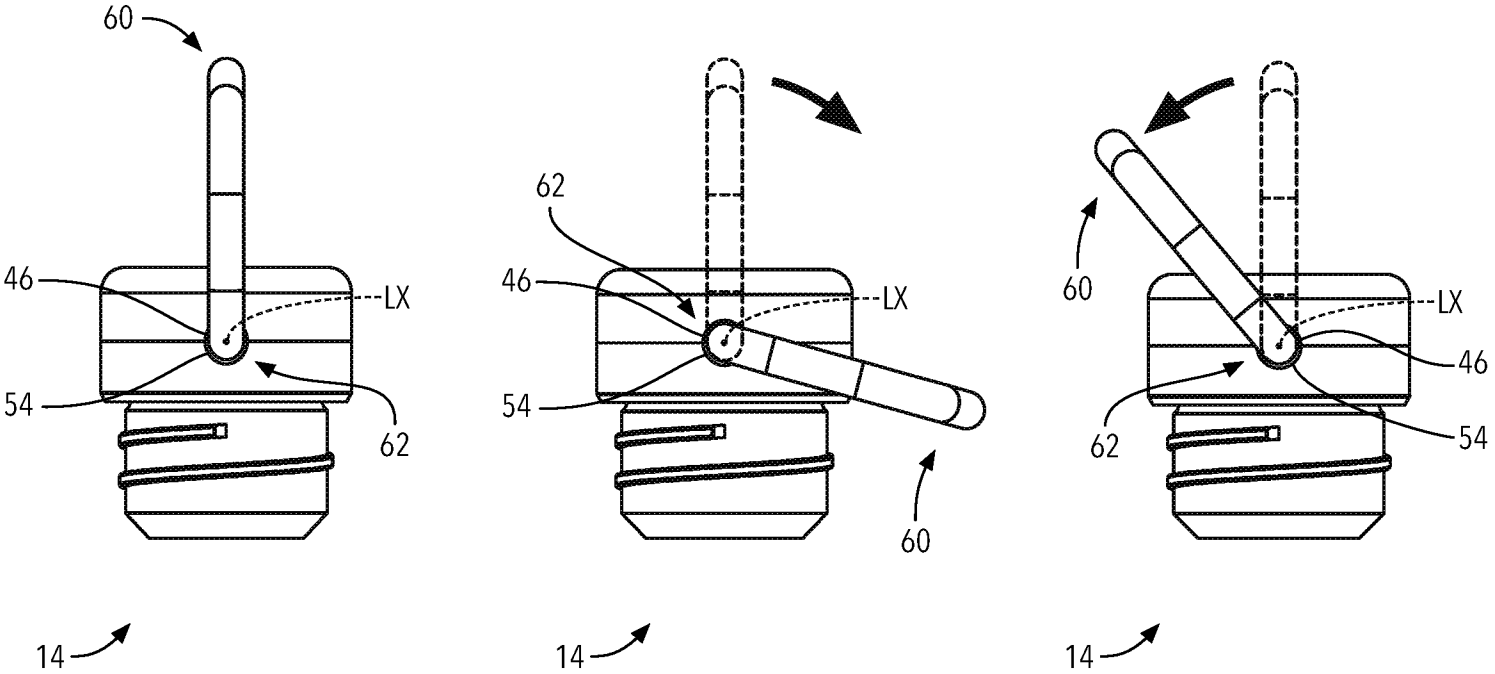
FIGS. 5A through 5C are right-side views of the cap shown in FIG. 4.

The following description should be taken in view of the aforementioned figures and FIGS. 5A through 5C which generally illustrate a side view of carabiner cap combination 14. As illustrated and discussed supra, carabiner 60 is fixedly secured within the through-bore (comprised of groove 54 and groove 46) of cap 14 such that carabiner may rotate about axis AX of distal section 62 of carabiner 60, shown representatively in FIGS. 5B and 5C specifically.

Figure 6A:
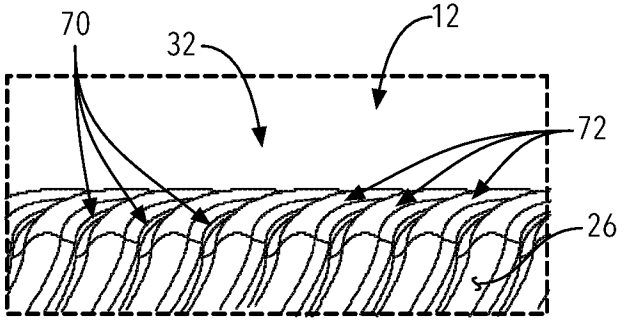
FIGS. 6A through 6D are generally taken from DETAIL 6 shown in FIG. 3.
Figure 6B:
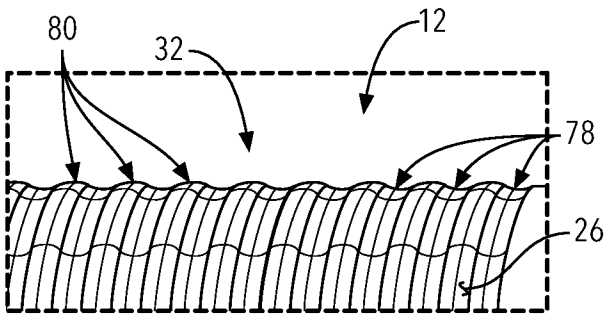
Figure 6C:
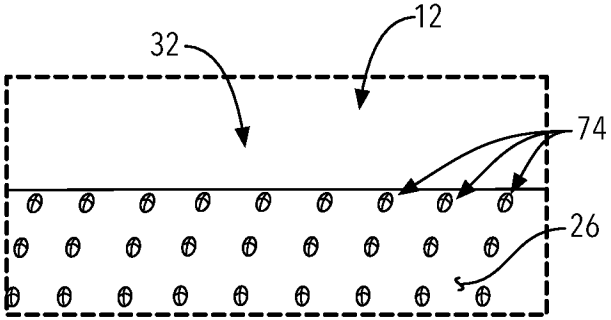
Figure 6D:
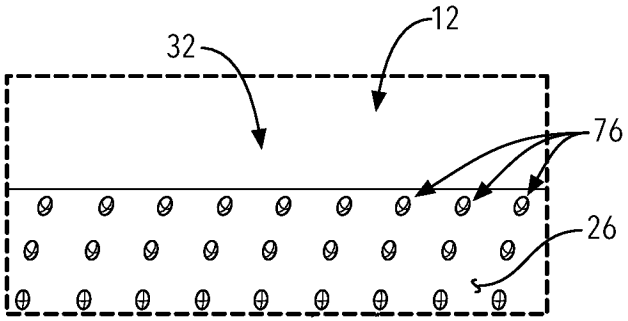

The following description should be taken in view of FIG. 2 and FIGS. 6A through 6D. FIGS. 6A through 6D illustrate an enlarged portion of container 12 taken generally from DETAIL 6 in FIG. 2. As discussed supra, container 12 may include plurality of gripping members 32 disposed on, within, or a combination thereof, outer surface 26. Each of plurality of gripping members 32 may be comprised of at least one of: sinusoidal groove 70 (shown in FIG. 6A); sinusoidal protrusion 72 (shown in FIG. 6A); annular groove 78 (shown in FIG. 6B); annular protrusion 80 (shown in FIG. 6B); dome-like protrusion 74 (shown in FIG. 6C); and, dome-like indentation 76 (shown in FIG. 6D). As such, plurality of gripping members 32 may be comprised of one of the aforementioned configurations or a combination of the aforementioned configurations, e.g., plurality of gripping members 32 may comprise a plurality of sinusoidal grooves 70 and a plurality of sinusoidal protrusions 72 (as shown in FIG. 6A), or plurality of gripping members 32 may comprise a plurality of annular grooves 78 and a plurality of annular protrusions 80 (as shown in FIG. 6B), or other combinations. As such, various arrangements of the plurality of gripping members, in addition to the coverage of the members on the outer surface of the container (i.e., partially covered, completely cover, etc.) are within the scope of the appended claims.

Figure 7A:
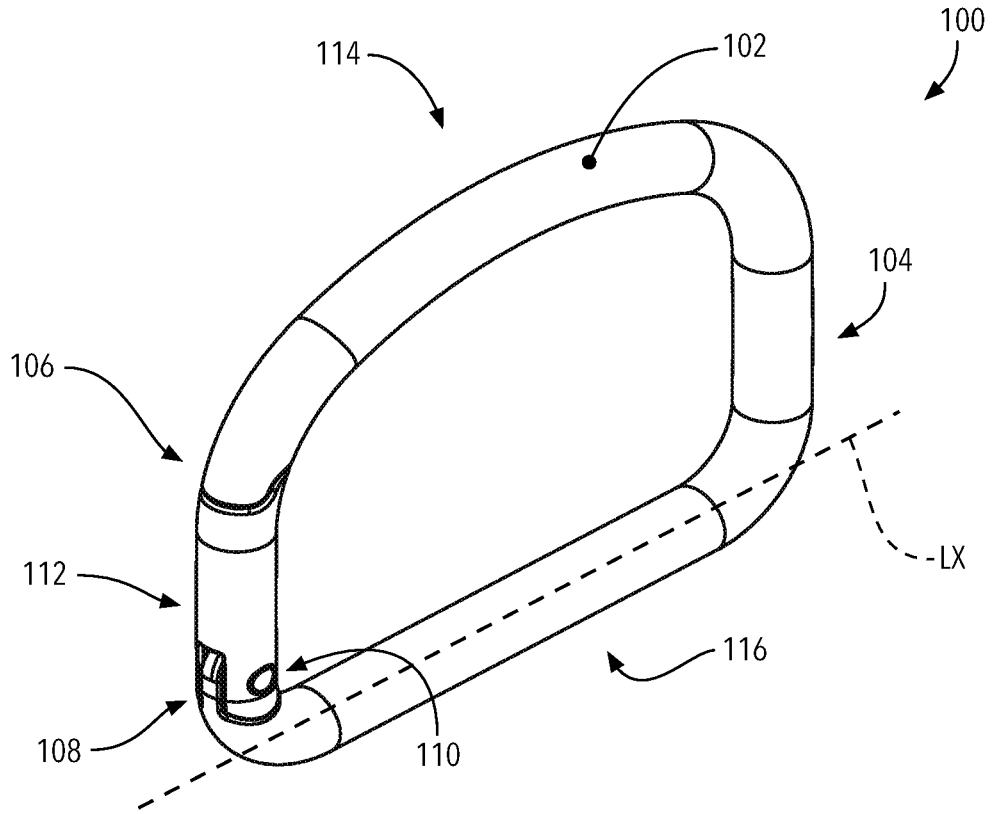
FIG. 7A is a perspective view of a carabiner of the present invention shown in FIG. 1.
Figure 7B:
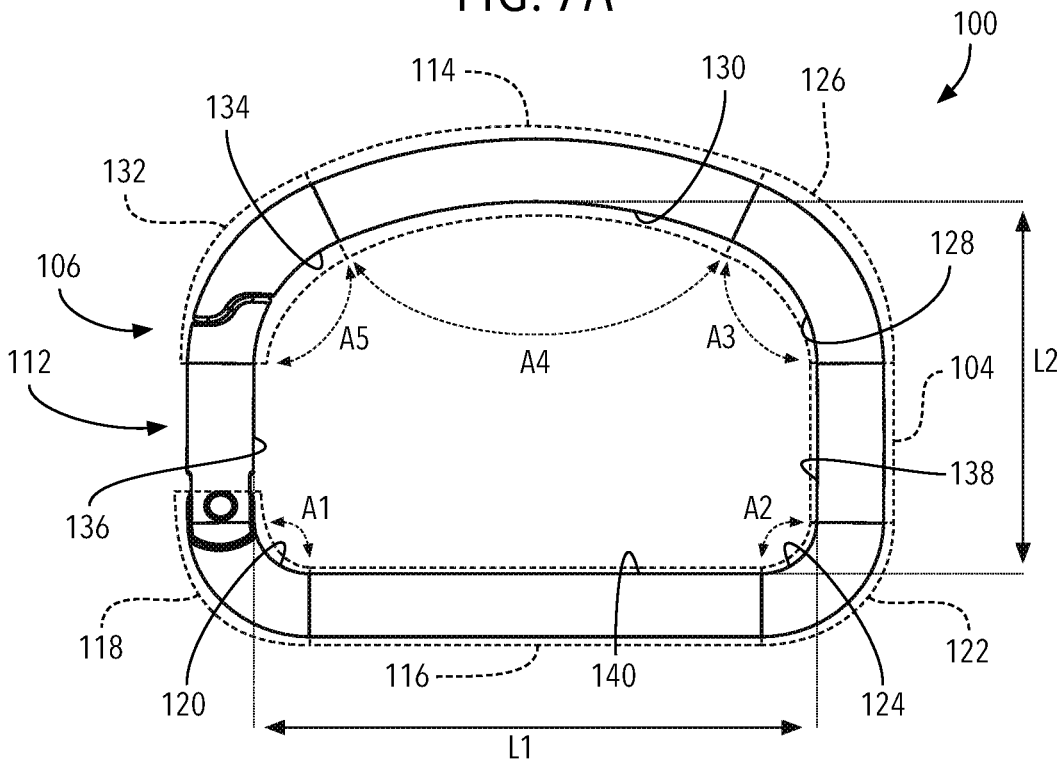
FIG. 7B is a front view of the carabiner shown in FIG. 7A.
Figure 8B:
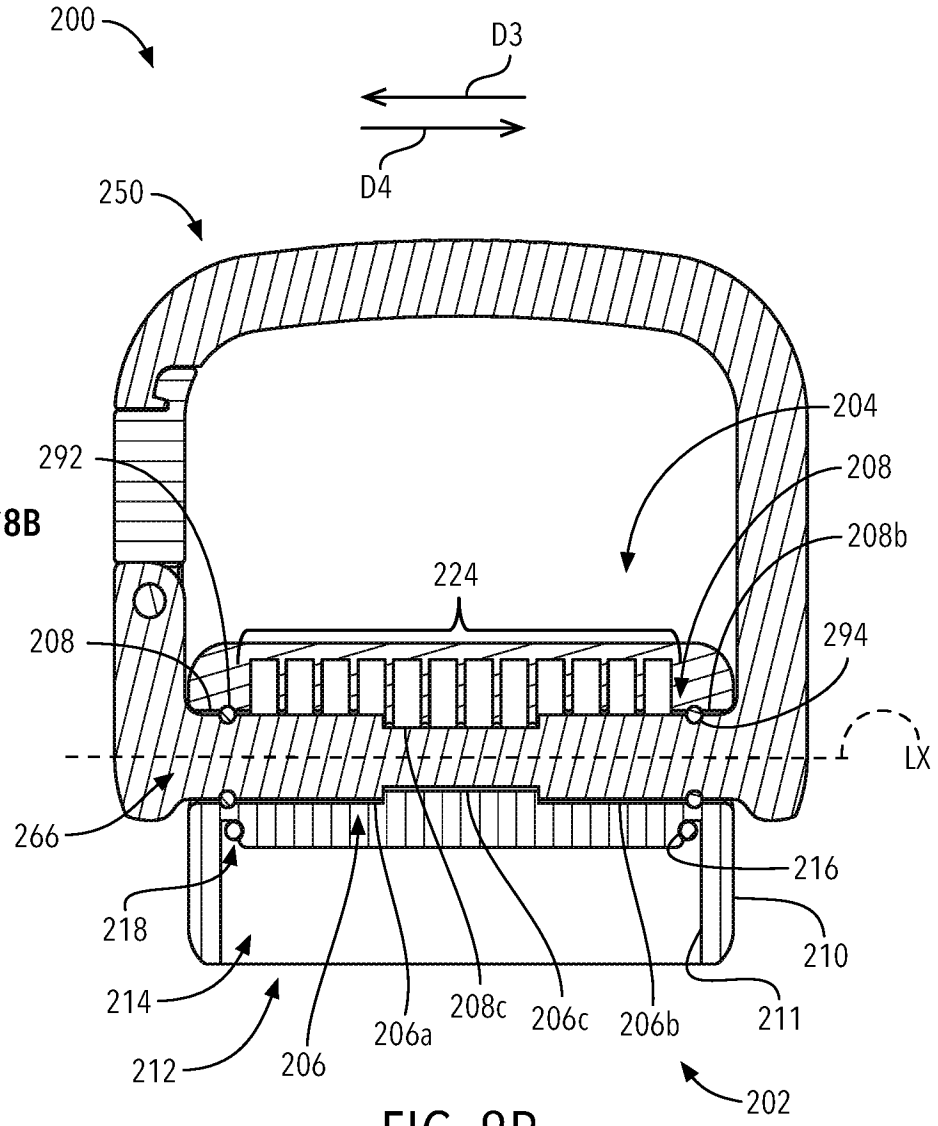
FIG. 8B is a cross-sectional view taken generally along line 8B-8B in FIG. 8A.
Figure 8A:
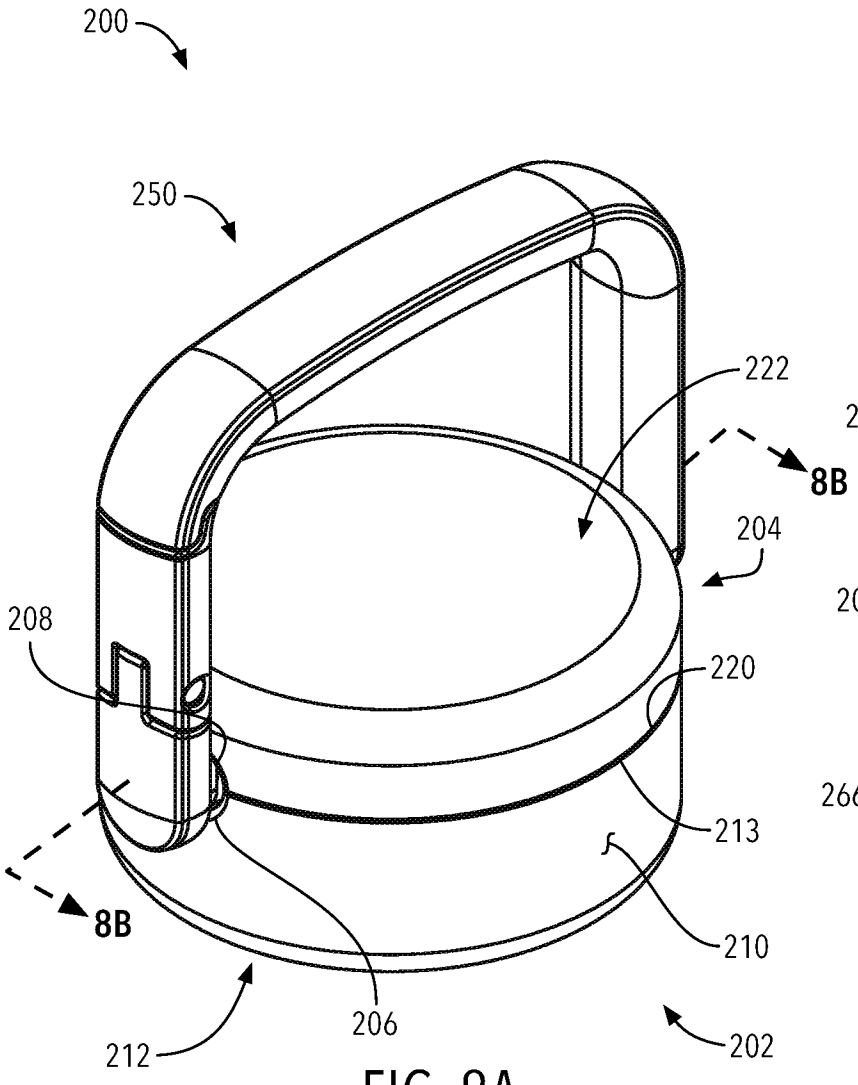
FIG. 8A is a perspective view of the cap shown of the present invention shown in FIG. 1 having an alternative embodiment of a carabiner therein.
Figure 9A:
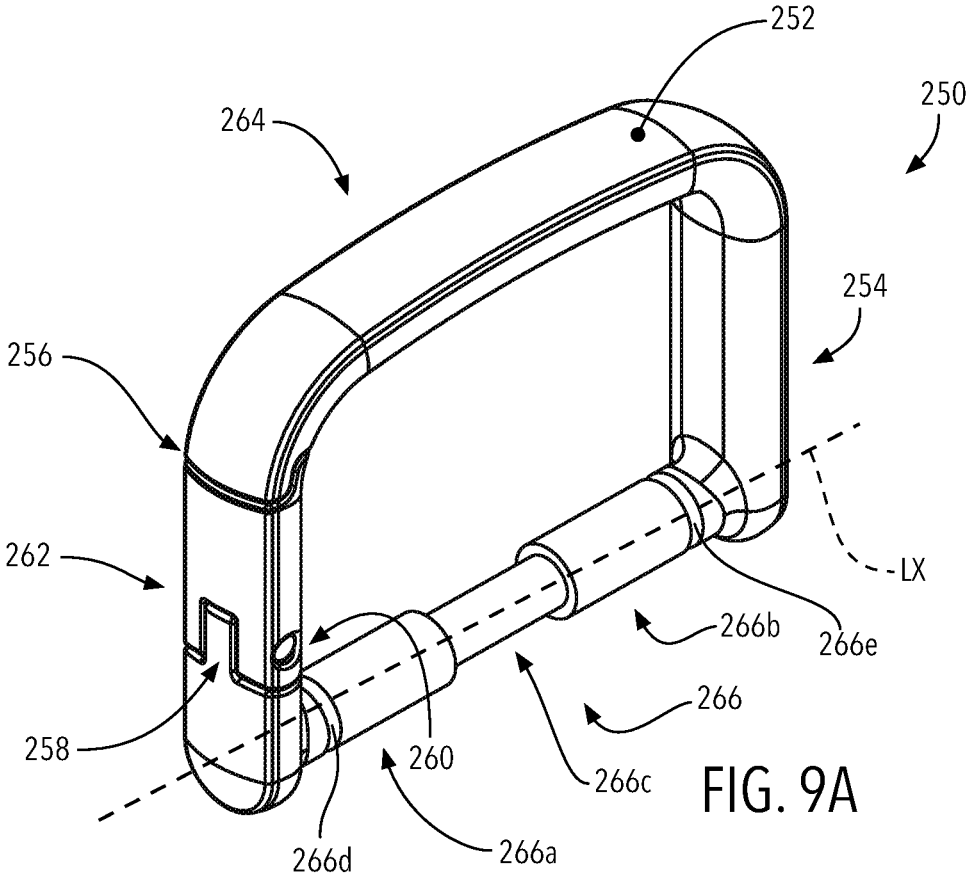
FIG. 9A is a perspective view of the carabiner shown in FIG. 8A.
Figure 9B:
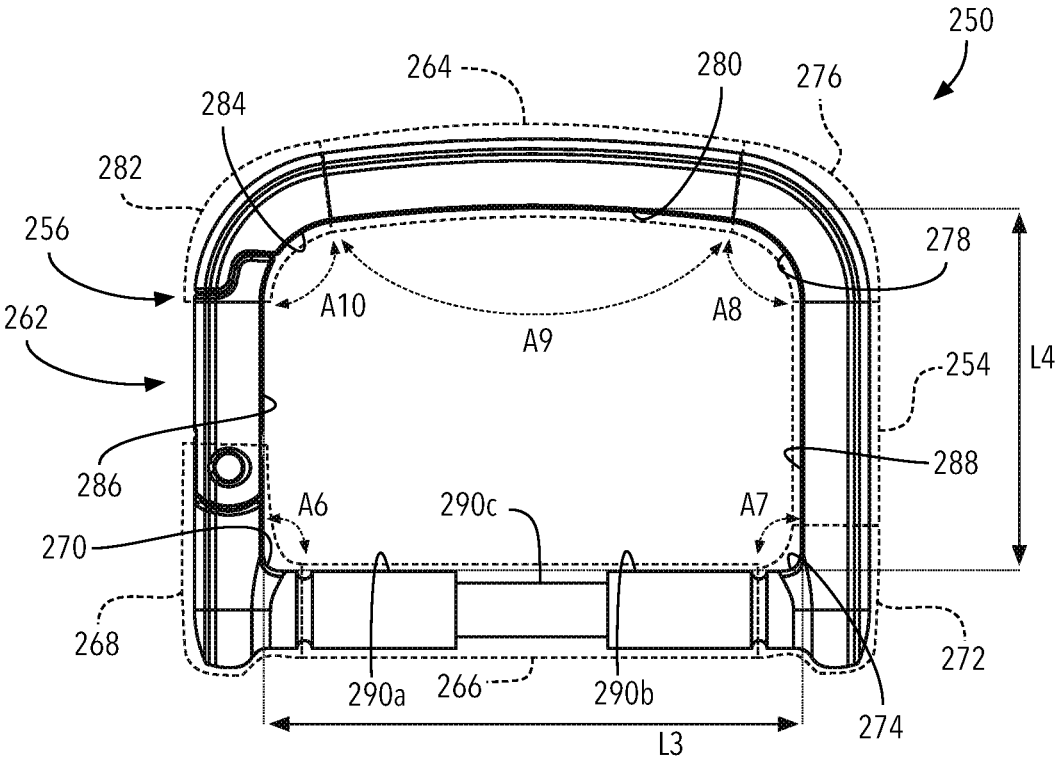
FIG. 9B is a front view of the carabiner shown in FIG. 8A.

The following description should be taken in view of FIGS. 7A and 7B which generally illustrates an embodiment of a carabiner used in some embodiments of the present invention. In some embodiments, carabiner 100 generally includes frame 102 having spine 104 disposed opposite of gate 112. Frame 102 is terminated by two end sections, nose 106 and pivot end 108. Pivot end 108 includes an aperture therein, where the aperture is arranged to accept pivot pin 110, thereby rotatably securing gate 112 to pivot end 108. In some arrangements, frame 102 includes elongated curve portion 114 which is arranged opposite of longitudinal portion 116, whereas spine 104 connects elongated curve portion 114 and longitudinal portion 116. Longitudinal portion 116 also includes longitudinal axis LX. Carabiner 100 is generally configured to have a substantially circular cross-section.

Pivot pin 110 could be a rivet, a fixed secured pin, or other like structure, so long as it can rotatably secure gate 112 to pivot end 108.

In a preferred embodiment, gate 112 includes a spring mechanism, or like mechanism, such that gate 112 forcibly contacts nose 106 until force is imparted thereon—allowing gate 112 to move in a direction towards spine 104. In some embodiments, gate 112 could also include a lock, such as a screw-lock which would threadably secure to nose 106, or a twist lock allowing gate 112 to be turned a specific degree to allow gate 112 to be released from nose 106, or a twist and pull lock which requires gate 112 to be twisted and slid down to release gate 112 from nose 106.

In some embodiments, frame 102 also includes pivot portion 118 which includes pivot end 108 and major arch 120 having angle A1. Pivot portion 118 is the connecting section between pivot end 108 and longitudinal portion 116. Longitudinal portion 116 includes inner face, or surface, 140. Longitudinal portion 116 and spine 104 are connected by first curved portion 122 having major arch 124. Major arch 124 includes angle A2, whereas angle A1 and angle A2 are substantially equal. Spine 104 includes inner face, or side, 138. Spine 104 and elongated curve portion 114 are connected by second curved portion 126 having minor arch 128, whereas minor arch 128 has angle A3. Elongated curve portion 114 includes elongated arch 130 having angle A4. Nose portion 132 includes nose 106 and is connected to elongated curve portion 114. Nose portion 132 includes minor arch 134 having angle A5. Gate 112 also includes inner face 136.

The distance between inner face 136 of gate 112 (when gate 112 is abutting nose 106) and inner face 138 of spine 104 is length L1. The distance between inner face, or surface 140 of longitudinal portion 116 and elongated arch 130 of elongated curve portion 114 is length L2. Length L1 is greater than length L2. In a preferred embodiment, length L1 and length L2 are in an approximate ratio of five to three, respectively. In other embodiments, length L2 may be approximately 50%-75% of length L1. In a preferred embodiment, length L1 is at least 66% longer than length L1.

Angle A1 of major arch 120 is substantially equal to angle A2 of major arch 124. Angle A3 of minor arch 128 is substantially equal to angle A5 of minor arch 134. Angles A1 and A2 are less than angles A3 and A5. Angle A4 of elongated arch 130 is greater than angles A3 and A5. Angle A4 of elongated arch 130 is greater than angles A1 and A2.

It should be noted that gate 112 is substantially equivalent to clip 68. Longitudinal portion 116 is substantially equivalent to distal section 62. Spine 104 is substantially equivalent to connecting section 66. Elongated curve portion 114 is substantially equivalent to proximal section 64. Nose 106 is substantially equivalent to first end 64*a*. Pivot end 108 is substantially equivalent to first end 62*a*. Pivot pin 110 is substantially equivalent to pivot pin 110. It also should be appreciated that either carabiner 60 or carabiner 100 may be used in cap 14 of the present invention.

The following description should be taken in view of the aforementioned figures and their respective description and FIG. 8A through 9B. FIG. 8A through 9B generally illustrate a perspective view and a cross-sectional view of an alternative embodiment of carabiner cap combination 14, carabiner cap combination 200, having an alternative embodiment of carabiners 60 and 100, carabiner 250, therein, and a perspective view and a front view of carabiner 250.

Carabiner cap combination 200 is preferably a singular component having carabiner 250 (or carabiner 60 or carabiner 100) fixedly secured within a through-bore therein. In some embodiments, carabiner cap combination 200 comprises distal portion 202 and proximal portion 204, whereas distal portion 202 and proximal portion 204 are arranged to be fixedly secured, having carabiner 250 therein, forming Carabiner cap combination 200.

In some embodiments, distal portion 202 of cap 200 generally includes distal surface 212, proximal surface 213, external surface 210, internal surface 211, and groove 206. In some arrangements, external surface 210, proximate distal surface 212 may have threading (similar to threading 44) arranged thereon. In other arrangements, internal surface 211, proximate distal surface 212 and within cavity 214, may have threading arranged thereon (similar to threading 44)—this arrangement may be configured to correspond to threading 30 of container 12 which may be alternatively arranged on outer surface 26 of mouth 24 of container 12. O-ring channel 216 is arranged within cavity 214 proximate groove 206 and is arranged to accept O-ring 218 therein. Groove 206 includes first outer portion 206*a*, second outer portion 206*b*, and inner portion 206*c*, where first outer portion 206*a* and second outer portion 206*b* have a great diameter than inner portion 206*c*.

In some arrangements, proximal portion 204 of carabiner cap combination 200 generally includes distal surface 220, proximal surface 222, and groove 208. Plurality of ribs 224 extend from distal surface 220 into groove 208 (i.e., protruding into groove 208). Groove 208 includes first outer portion 208*a*, second outer portion 208*b*, and inner portion 208*c*, where first outer portion 208*a* and second outer portion 208*b* have a diameter greater than the diameter of inner portion 208*c*.

Grooves 206 and 208, when distal portion 202 and proximal portion 204 are joined, form the through-bore that fixedly and rotatably holds carabiner 250, specifically longitudinal portion 266, therein.

In some embodiments, carabiner 250 generally includes frame 252 having spine 254 disposed opposite of gate 262. Frame 252 is terminated by two end sections, nose 256 and pivot end 258. Pivot end 258 includes an aperture therein, where the aperture is arranged to accept pivot pin 260, thereby rotatably securing gate 262 to pivot end 258. In some arrangements, frame 252 includes elongated curve portion 264 which is arranged opposite of longitudinal portion 266, whereas spine 254 connects elongated curve portion 264 and longitudinal portion 266. Longitudinal portion 266 includes first outer section 266*a*, second outer section 266*b*, and inner section 266*c*, whereas first outer section 266*a* and second outer section 266*b* have a greater diameter than inner section 266*c*. Longitudinal portion 266 also includes first groove 266*d* disposed within first outer section 266*a* and second groove 266*e* disposed within second outer section 266*b*. First groove 266*d* and second groove 266*e* are annular channels and are arranged to accept first carabiner O-ring 292 and second carabiner O-ring 294 therein, respectively. Longitudinal portion 266 also includes longitudinal axis LX. Longitudinal portion 266 is arranged to have a substantially circular cross-section.

Pivot pin 260 could be a rivet, a fixed secured pin, or other like structure, so long as it can rotatably secure gate 262 to pivot end 258.

In a preferred embodiment, gate 262 includes a spring mechanism, or like mechanism, such that gate 262 forcibly contacts nose 256 until force is imparted thereon—allowing gate 262 to move in a direction towards spine 254. In some embodiments, gate 262 could also include a lock, such as a screw-lock which would threadably secure to nose 256, or a twist lock allowing gate 262 to be turned a specific degree to allow gate 262 to be released from nose 256, or a twist and pull lock which requires gate 262 to be twisted and slid down to release gate 262 from nose 256.

In some embodiments, frame 252 also includes pivot portion 268 which includes pivot end 258 and major arch 270 having angle A6. Pivot portion 268 is the connecting section between pivot end 258 and longitudinal portion 266. Longitudinal portion 228 includes inner faces, or surfaces, 290*a*, 290*b*, and 290*c*, arranged on first outer section 226*a*, second outer section 266*b*, and inner section 266*c*, respectively. Longitudinal portion 266 (specifically, second outer section 266*b*) and spine 254 are connected by first curved portion 272 having major arch 274. Major arch 274 includes angle A7, whereas angle A6 and angle A7 are substantially equal. Spine 254 includes inner face, or side, 288. Spine 254 and elongated curve portion 264 are connected by second curved portion 276 having minor arch 278, whereas minor arch 278 has angle A8. Elongated curve portion 264 includes elongated arch 280 having angle A9. Nose portion 282 includes nose 256 and is connected to elongated curve portion 264. Nose portion 282 includes minor arch 284 having angle A10, whereas angle A10 and A8 are substantially equal. Gate 262 also includes inner face 286.

The distance between inner face 286 of gate 262 (when gate 262 is abutting nose 256) and inner face 288 of spine 254 is length L3. The distance between inner faces, or surfaces 290*a* and 290*b* of first outer section 266*a* and second outer section 266*b* of longitudinal portion 266 and elongated arch 280 of elongated curve portion 264 is length L4. Length L3 is greater than length L4. In a preferred embodiment, length L3 and length L4 are in an approximate ratio of five to three, respectively. In other embodiments, length L4 may be approximately 50%-75% of length L3. In a preferred embodiment, length L3 is at least 66% longer than length L4.

Angle A6 of major arch 270 is substantially equal to angle A7 of major arch 274. Angle A8 of minor arch 278 is substantially equal to angle A10 of minor arch 284. Angles A6 and A7 are less than angles A8 and A10. Angle A9 of elongated arch 280 is greater than angles A8 and A10, and also may be greater than angle A4 of carabiner 100 (shown in FIG. 7B). Angle A9 of elongated arch 280 is greater than angles A6 and A7. In some embodiments, angles A8 and A10 may be less than angles A3 and A5 of carabiner 100 (shown in FIG. 7B). The relationships between the angles of carabiner 100 and carabiner 250, are recited below:

$$A1 = A2$$
$$A3 = A5$$
$$A1 < A3$$
$$A1 < A5$$
$$A2 < A3$$
$$A2 < A5$$
$$A1 < A4$$
$$A2 < A4$$
$$A3 < A4$$
$$A6 = A7$$
$$A8 = A10$$
$$A6 < A8$$
$$A6 < A10$$
$$A7 < A8$$
$$A7 < A10$$
$$A6 < A9$$
$$A7 < A9$$
$$A8 < A9$$
$$A10 < A9$$
$$A4 < A9$$
$$A1 = A6$$
$$A1 = A7$$
$$A2 = A6$$
$$A2 = A7$$
$$A8 < A3$$
$$A8 < A5$$
$$A9 < A3$$
$$A9 < A5$$

It also should be appreciated that either carabiner 60, carabiner 100, or carabiner 200 may be used in cap 14 of the present invention.

It should be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

REFERENCE NUMERALS

2 Article
4 Ring
10 Carabiner bottle
12 Container
14 Carabiner cap combination
15 Body of cap 14
16 O-Ring
18 Distal end
20 Proximal end
22 Body
24 Mouth
26 Outer surface
28 Inner surface
30 Threading
32 Plurality of gripping members
34 Neck
36 Distal portion
38 Proximal portion
40 Distal surface
41 Proximal surface
42 Protrusion
43 Outer surface
44 Threading
45 First cavity
46 Groove
46*a* Groove body
47 Second cavity
48 Channel
50 Distal surface
52 Proximal surface
54 Groove
54*a* Groove body
55 First cavity
56 First protruding section
57 Second cavity
58 Second protruding section
60 Carabiner
62 Distal section
62*a* First end
62*b* Second end
62*c* Pin
62*d* Longitudinal portion
64 Proximal section
64*a* First end
64*b* Second end
66 Connecting section
66*a* First end
66*b* Second end
68 Clip
68*a* First end
68*b* Second end
68*c* Aperture
69 Locking sleeve
70 Sinusoidal groove
72 Sinusoidal protrusion
74 Dome-like protrusions
76 Dome-like indentations
78 Annular groove
80 Annular protrusion
100 Carabiner
102 Frame
104 Spine
106 Nose
108 Pivot end
110 Pivot pin
112 Gate
114 Elongated curve portion
116 Longitudinal portion
118 Pivot portion
120 Major arch
122 First curved portion
124 Major arch
126 Second curved portion
128 Minor arch
130 Elongated arch
132 Nose portion
134 Minor arch
136 Inner face
138 Inner face
140 Inner face
200 Cap
202 Distal portion
204 Proximal portion
206 Groove
206*a* First outer portion
206*b* Second outer portion
206*c* Inner portion
208 Groove
208*a* First outer portion
208*b* Second outer portion
208*c* Inner portion
210 External surface
211 Internal surface
212 Distal surface
213 Proximal surface
214 Cavity
216 O-ring channel
218 O-ring
220 Distal surface
222 Proximal surface
224 Plurality of ribs
250 Carabiner
252 Frame
254 Spine
256 Nose
258 Pivot end
260 Pivot pin
262 Gate
264 Elongated curve portion
266 Longitudinal portion
266*a* First outer section
266*b* Second outer section
266*c* Inner section
266*d* First groove
266*e* Second groove
268 Pivot portion
270 Major arch
272 First curved portion
274 Major arch
276 Second curved portion
278 Minor arch
280 Elongated arch
282 Nose portion
284 Minor arch
286 Inner face
288 Inner face
290*a* Inner face
290*b* Inner face
290*c* Inner face
292 First carabiner O-ring
294 Second carabiner O-ring
A1 First angle A2 Second angle
A3 Third angle
A4 Fourth angle
A5 Fifth angle
A6 Sixth angle
A7 Seventh angle
A8 Eighth angle
A9 Ninth angle
A10 Tenth angle
Axis AX
D1 Direction
D2 Direction
D3 Direction
D4 Direction
L1 First length
L2 Second length
L3 Third length
L4 Fourth length
LX Longitudinal axis

What is claimed is:

1. A carabiner cap combination, comprising:

a cap having a proximal end and a distal end, a protrusion extending from said distal end, said protrusion having threads arranged on an outer surface, said cap having a distal portion having a lower groove arranged therein, said cap having a proximal portion having an upper groove arranged therein, wherein said proximal portion is arranged to be fixedly secured to said distal portion such that said lower groove and said upper groove form a through-bore within said cap and between said proximal and distal ends of said cap, said through-bore having a longitudinal axis and a pair of openings disposed colinearly about said longitudinal axis, said pair of openings arranged on an external surface of said cap; and, a carabiner, said carabiner having a proximal section, a distal section, and a gate, said distal section of said carabiner fixedly and directly secured to said cap within said through-bore, wherein said carabiner is adapted to rotate within said through-bore of said cap.

2. A container having a proximal end and a distal end, said container comprising a mouth arranged at said proximal end, wherein said protrusion of said carabiner cap combination recited in claim 1 is arranged to be threadedly secured to said mouth of said container, thereby forming a container and carabiner cap combination.

3. The container recited in claim 2 further comprising an outer surface and a plurality of gripping members arranged on and circumscribing at least a portion of said outer surface of said container.

4. The container recited in claim 3, wherein said plurality of gripping members are arranged on a portion of said outer surface and disposed between said first end and said second end of said container.

5. The container recited in claim 4, where each of said plurality of gripping members may comprises at least one of:

a plurality of sinusoidal grooves;
a plurality of sinusoidal protrusions;
a plurality of annular grooves;
a plurality of annular protrusions;
a plurality of dome-like indentations; and,
a plurality of dome-like protrusions.

6. The container and carabiner cap combination recited in claim 2 further comprising an O-ring arranged to be sandwiched between said mouth of said container and said protrusion of said cap when said cap is engaged to said mouth.

7. The cabined cap combination recited in claim 1, wherein said carabiner comprises:

a frame comprised of said proximal section of said carabiner and aid distal section of said carabiner, said frame having a nose arranged at a first end and a pivot end arranged at a second end, said frame having a spine arranged substantially between said nose and said pivot end, said frame including an arched portion arranged proximate said nose, said frame also including a longitudinal portion proximate said pivot end, said longitudinal portion being a part of the distal section of said carabiner; and, said gate pivotably secured to said pivot end and arranged to engage said nose, wherein said gate and said spine are spaced part at a first length, wherein said arched portion and said longitudinal portion are spaced apart at a second length, whereas said first length is greater than said second length, wherein:

said longitudinal portion of said frame is said part of said carabiner secured within said through-bore of said cap.

8. The carabiner recited in claim 7, wherein said first length is 50-75% longer than said second length.

9. The carabiner recited in claim 7, wherein said first length is at least 66% longer than said second length.

* * * * *